United States Patent [19]

Diamond et al.

[11] Patent Number: 4,627,354

[45] Date of Patent: Dec. 9, 1986

[54] LAUNCHABLE AEROSOL GRENADE

[75] Inventors: George B. Diamond, Anthony & Woodglen Rds., Glen Gardner, N.J. 08826; Ralph H. Helmrich, Glen Gardner, N.J.

[73] Assignee: George B. Diamond, Glen Gardner, N.J.

[21] Appl. No.: 649,982

[22] Filed: Sep. 13, 1984

[51] Int. Cl.[4] ..... F42B 27/06

[52] U.S. Cl. ..... 102/368; 102/293; 102/370; 102/502

[58] Field of Search ..... 102/367–370, 102/334, 293, 395, 512, 513, 502, 529; 42/1 F

[56] References Cited

U.S. PATENT DOCUMENTS

| | | | |
|---|---|---|---|
| 1,357,927 | 11/1920 | Clarke | 102/513 X |
| 1,632,147 | 6/1927 | Ragsdale | 102/395 |
| 1,779,617 | 10/1930 | Pavola | 102/369 |
| 1,819,415 | 8/1931 | Harris | 102/512 |
| 2,617,359 | 11/1952 | Van Horn et al. | 102/512 |
| 3,683,815 | 8/1972 | Shaffer | 102/368 |
| 3,685,450 | 8/1972 | Walbeck et al. | 102/334 |
| 3,831,520 | 8/1974 | Bowen et al. | 102/369 |
| 4,044,684 | 8/1977 | Gaggini et al. | 102/370 |
| 4,109,579 | 8/1978 | Carter | 102/529 X |
| 4,195,572 | 4/1980 | Knapp | 102/293 X |

FOREIGN PATENT DOCUMENTS

| | | | |
|---|---|---|---|
| 2033554 | 5/1980 | United Kingdom | 102/512 |

*Primary Examiner*—David H. Brown

*Attorney, Agent, or Firm*—Ostrolenk, Faber, Gerb & Soffen

[57] ABSTRACT

A projectile for delivering to a target a can containing pressurized material which is to be dispersed over the area of target. The projectile includes a cylindrical hollow housing to the rear end of which is attached a launching tube with a fin assembly. The can is slidably disposed within the housing. There is a space between a cap which closes the forward end of the housing and the can in the housing. The can slides forward in the housing toward the cap upon impact of the cap against the target. This opens a valve which releases the contents of the sealed can into the housing, and this, in turn, blows the cap off the housing so that the released material is dispersed over the target area. With the present projectile, the sealed can is not breached before the projectile strikes its target and the contents of the can may be dispersed in a very short time.

14 Claims, 4 Drawing Figures

LAUNCHABLE AEROSOL GRENADE

BACKGROUND OF THE INVENTION

The present invention relates to a projectile suitable for delivering a quantity of pressurized material, and particularly, to an aerosol grenade which is adapted to be launched, from a gun or similar device, and which does not begin releasing the pressurized material until impact of the projectile.

. Some gaseous materials must be released at a location away from the party who wants to release them for effective use of these materials and for protection of the party releasing them. For example, law enforcement personnel may use tear gas or similar disabling agents to control crowds and to dislodge barricaded persons and those personnel wish to be able to disperse the tear gas over a target area which they are away from. The law enforcement personnel who use such disabling agents should be protected from accidental discharge. Furthermore, it must be assured that a person at whom a tear gas grenade is targeted is not able to capture the still active tear gas grenade and throw it back.

In the prior art, dispersable materials, e.g. tear gas, were dispersed by various techniques. In one technique, the dispersable material was combined with a flammable material. Burning the combined materials vaporized them and they thereafter spread as a smoke cloud. In another technique, the dispersable material is packed with an explosive charge which detonates upon impact and causes the dispersable material to spread over an area.

The major shortcomings of these prior art techniques is that the combustion or explosion associated with each technique poses a fire or concussion hazard to buildings, property and people. A container with slow burning contents can be picked up and thrown back at law enforcement personnel. An exploding projectile can cause injury. If a projectile does not explode upon impact, it poses a danger to innocent bystanders or police personnel who attempt to retrieve it.

U.S. Pat. No. 4,195,572 discloses a projectile which is filled with a dispersable material and which is suitable for launching by a gun. The material is stored in a pressurized can in a housing. The rear or bottom end of the housing, which is the end toward the user, carries a piercing pin. The can is slidably mounted in a housing and is spaced away from the pin. As the projectile is launched, the inertia of the can impacts it against the piercing pin and the bottom of the can is punctured. The later impact of the front of the projectile hitting a target releases the can from the piercing pin and the pressurized contents of the can are discharged through its pierced bottom and pass out through holes in the hollow housing.

In the above described projectile device, the pressurized container is pierced before the projectile reaches its destination, i.e. at launch. This poses the danger that the contained material may be released before impact of the projectile. Further still, the punctured can could explode at launch or disperse material over the person firing the projectile. Furthermore, the device of the U.S. Pat. No. 4,195,572, as well as other prior devices, releases the pressurized material slowly, so that the can could be picked up and hurled back at law enforcement personnel.

SUMMARY OF THE INVENTION

It is an object of the present invention to provide a non-flammable and non-explosive projectile for delivering pressurized material which is to be dispersed at a target area.

It is another object of the invention to provide a launchable projectile in which the can holding the dispersable material remains intact prior to reaching the target.

It is still another object of the invention to provide a launchable pressurized can be rapidly releasing tear gas, or the like, upon impact of a projectile containing the can.

A further object of the invention is to prevent that can from being able to be picked up by anyone in the target area before the pressurized contents have been dispensed.

The foregoing and other objects are realized with a non-flammable, non-explosive projectile including a sealed can containing dispersable material, which can is breached for commencing release of its contents only after the projectile has impacted at its intended target. The projectile includes a hollow housing. A launching tube extends rearward from the bottom or rear of the housing. A fin assembly around the launching tube regulates the flight of the projectile to assure that the housing section leads the launching tube. The sealed pressurized can has a cross-section such that it fits inside the hollow housing, so that some predetermined force is required to cause the can to slide through the housing. The can is initially positioned toward the rear and bottom of the housing. The length of the can is so selected that a free space remains between the can and the top of the housing. The top surface of the can which faces the top of the housing is provided with an exit mechanism for the material to be dispersed.

The top of the housing is covered by a cap which holds the can in the housing. The cap is intended to pop off after impact. For example, the cap is friction fitted over the top of the housing. An actuating mechanism, disposed in the space between the top of the can and the cap of the housing, operates the exit mechanism of the can. This may simply be a pin to pierce the can or an operator for a release valve in the can.

Upon being launched, the projectile is oriented through the action of the fin assembly such that the intended target will be struck by the cap of the projectile. Upon impact, the sealed can inside is slid under inertial force toward the cap of the housing causing interaction of the exit and actuating mechanisms for allowing the contents to violently exit the can and forcefully fill the space between the can and the cap cover. As sufficient pressure develops in this space, the cap, which is only frictionally held over the top of the housing, is popped off and the gaseous contents of the can exit the can and the housing and are immediately dispersed over the target area.

A larger opening in the exit mechanism permits the contents of the can to be evacuated so rapidly that if someone in the target area were to pick up the projectile for the purposes of throwing it away or hurling it at law enforcement officials, its contents would already have been dispersed. Further, when the cap is popped off under pressure following impact, this pops the projectile up off the ground, making it more difficult to be picked up before all of the can contents have exited. Additionally, because the pressurized contents of the can are released effectively all at once, the dispersable material is able to spread over a larger area. Also, since the projectile pops up while it discharges, much of the can contents are dispersed at head and face level wherein it is much more effective than at ground level.

There may be any of several actuating mechanisms in the form of means for piercing the sealed can upon impact. In one embodiment, the top surface area of the can which faces forward toward the top of the housing is provided with a frangible covering. The cap of the housing carries a piercing pin which extends rearward into the housing toward the frangible cover of the can. Upon impact, the can slides towards the cap of the housing and the piercing pin shatters the frangible cover.

In an alternate embodiment, the can has a large exit opening fitted with a one-shot valve which remains sealed prior to the impact of the projectile. Detenting protrusions ensure that, once it is opened upon impact, the valve remains open. As the projectile strikes the target, the can in the housing slides forward and the valve operating tube of the valve impacts against the cap of the housing which opens the valve. The valve operating tube may be sufficiently elongate to contact the cap itself, or an actuating pin extending down from the cap may actuate the valve.

In a particular embodiment, the fins of the fin assembly may be folded around the launch tube of the projectile to allow the projectile to be launched directly from a barrel of a gun.

Other features and advantages of the invention will be apparent from the following description of preferred embodiments of the invention considered with reference to the accompanying drawings.

DETAILED DESCRIPTION OF PREFERRED EMBODIMENTS

Figure 1:
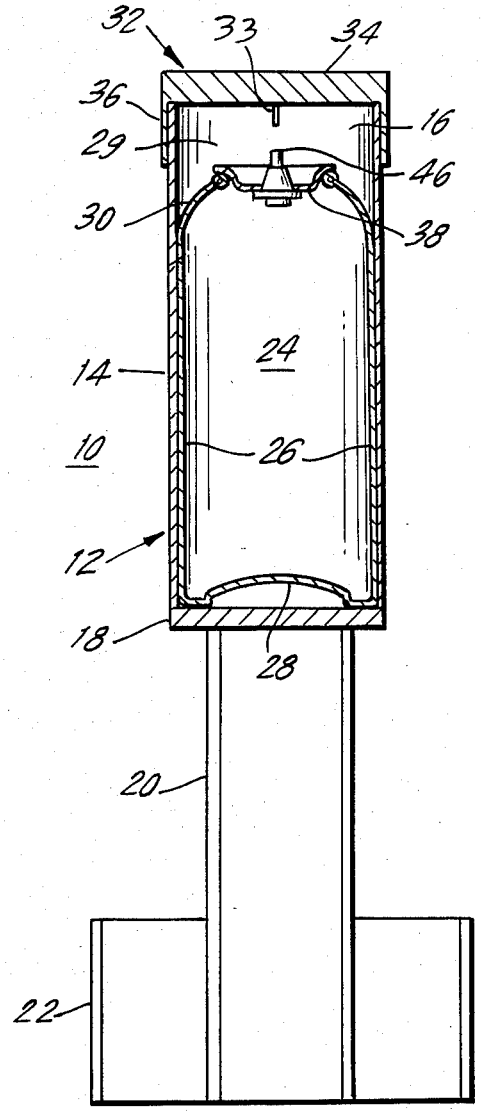
FIG. 1 is a cross-sectional, elevational view showing a projectile according to a preferred embodiment of the invention before impact of the projectile.
Figure 2:
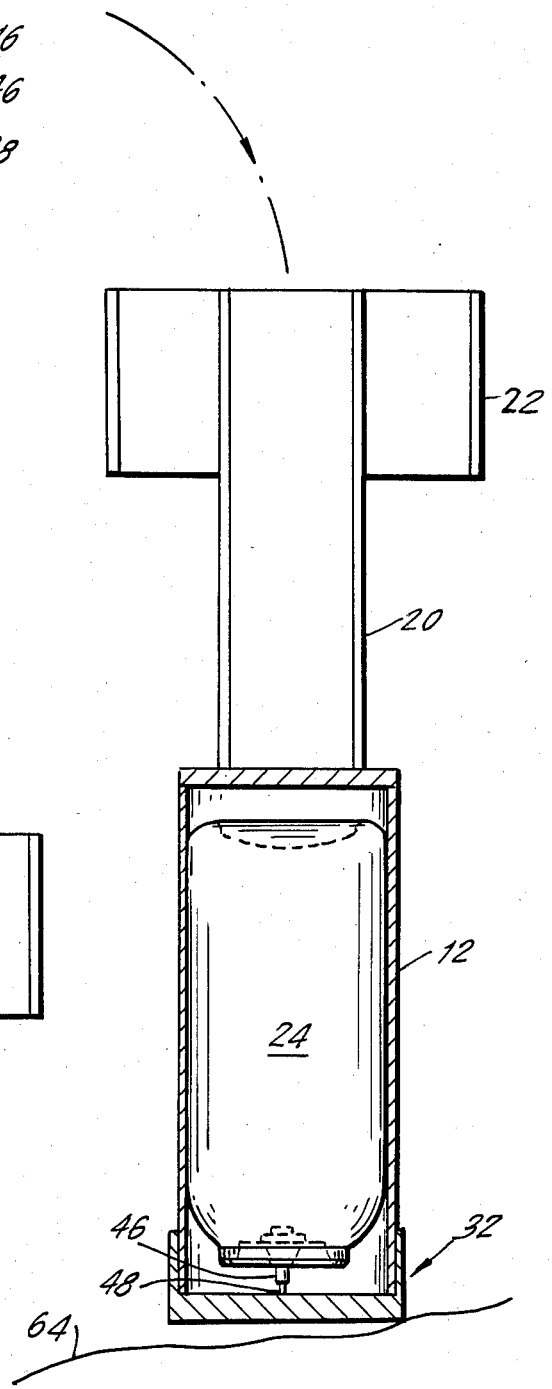
FIG. 2 shows the projectile after it impacts its intended target.

Referring to FIG. 1, the projectile 10 according to the invention includes a hollow cylindrical housing 12 defined by annular peripheral side wall 14, an open top 16 and a closed bottom 18. A launch tube 20 is fixed to and projects from the bottom 18 of the housing. The launch tube 20 is preferably a cylindrical elongate shaft which is dimensioned so that the projectile can be launched by a spigot launcher (not shown) from a gun barrel. The launch tube 20 is fitted with a fin assembly 22 at its end away from the housing 12. The fin assembly ensures that the projectile may fly accurately and over a greater distance and that the projectile strikes the target front end first.

A sealed pressurized can 24 containing the material which is to be dispersed over a target area is inserted into the housing 12 as shown in FIG. 1. The can 24 comprises a cylindrical body, defined by a cylindrical peripheral side wall 26 and a closed bottom 28. The outer cross-sectional shape and dimension of the can 24 are such that it friction fits into the housing 12 of the projectile after it is installed through the open top 16. The can 24 is initially positioned rearwardly to the bottom of the housing where it is retained by the very light friction fit between the can side wall 26 and the peripheral side wall 14 of the housing. The axial length of the can 24 is shorter than the axial length of the housing 12 so that an open space 29 remains between the top surface 30 of the can and the open top 16 of the housing.

With the can 24 in the housing 12, the open top 16 of the housing is covered by a cap 32. The cap 32 comprises a flat top 34 surrounded by a peripheral skirt 36. The skirt of the cap tightly friction fits over the open top 16 of the housing 12.

Two mechanisms for releasing materials from the can 24 when the projectile 10 strikes its target are now described with reference to FIGS. 1, 3 and 4. The side wall 26 of the can 24 defines an upper opening 38 which is sealed by an upper closure 40 which fits over the chime 42 of the upper opening 38. There is a discharge opening 44 centrally located in the closure 40.

Figure 3:
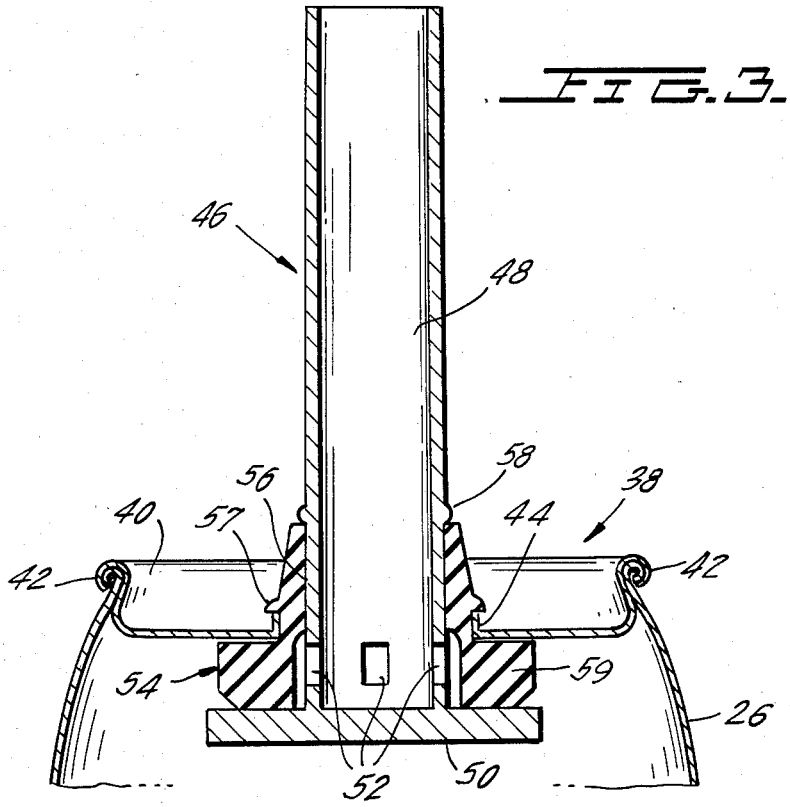
FIGS. 3 and 4 show preferred embodiments for opening the can upon impact.

In the embodiment of FIG. 3, a valve 46 closes the discharge opening 44. The valve comprises an elongate hollow tube 48 with a disc bottom 50 which closes off the lower end of the tube 48 and which has a surface area which is larger than the area bounded by the discharge opening 44. The hollow tube 48 includes perforations 52 adjacent its bottom 50 which provide a passageway from the cap into the hollow tube 48. An elastic sealing gasket 54 of rubber, which does not change in character in the presence of the can contents or affect the can contents, and having a central opening 56, is fitted in the discharge opening 44 of the upper closure 40 of the can. The annular detent projection 57 cooperates with the thickened base 59 of the seal to hold it in the opening 44. The valve tube 48 is slidably friction fitted in the central opening 56 of the seal 54. As presently positioned, the base 59 of the seal 54 surrounds and covers up the perforations 52 of the valve tube 48. The bottom 50 of the valve is pressed against the seal base 59 by the internal pressure in the can. The valve tube 48 is also provided with locking projections 58 for locking the valve open, as described below.

The valve 46 shown in FIG. 3 is referred to as a "one-shot" valve, which remains in its open position once actuated. As the tube 48 is pushed into the can 24 upon impact of the projectile, the projections 58 will be locked below the base of the elastic seal 54 and the valve tube 48 will be prevented from returning to its original position. In the open position, the perforations 52 of the valve are no longer closed by the elastic seal 54 and the contents of the can are allowed to enter the perforations 52 and exit through the inner hollow passage of the tube 48.

In operation, upon impact between the projectile and an object 64, inertial force will slide the can away from the closed bottom 18 of the housing 12 toward the cap 32. The valve tube 48 is sufficiently long so that the valve tube strikes the cap 32. In particular, valve 46 strikes the projection 33 inside the cap 32. This movement of the can will open the valve 46 and allow the contents of the can 24 to escape into the housing 12 of the projectile 10. The pressure then separates the cap 32 from the housing 12. Thereafter, the pressurized contents of the can 24 are immediately dispersed over the target area due to the large opening of the valve 46 and the highly pressurized contents of the can.

Figure 4:
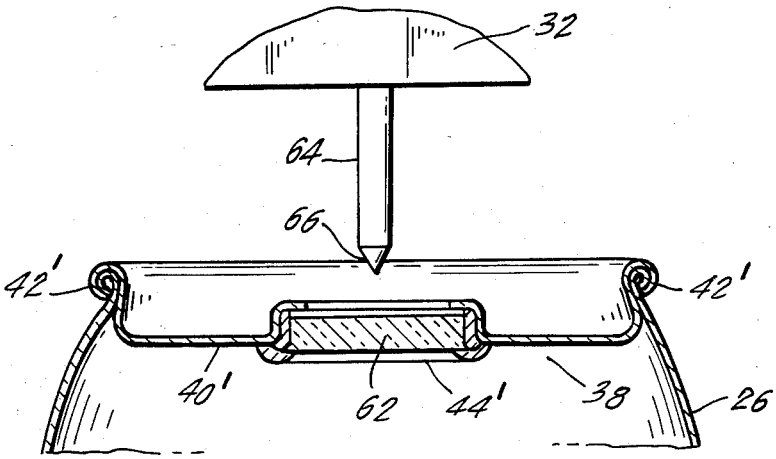

Another valve mechanism is shown in FIG. 4. The discharge opening 44' of the closure 40' is covered by a frangible disk 62. A piercing pin 64 is fixed to the cap 32 at one end, and the other end of the pin provided with a sharp edge 66. Upon impact, the can 32 slides forward and the frangible disk 62 is shattered by the piercing pin 64. Thereafter, the contents of the can 24 escape and are dispersed as described above.

Although the present invention has been described in connection with preferred embodiments, many variations and modifications will now be apparent to those skilled in the art. It is preferred, therefore, that the present invention be limited not by the specific disclosure herein, but only by the appended claims.

What is claimed is:

1. A projectile for delivering a quantity of pressurized material to a target area and for dispersing said material at the target area, said projectile comprising:

a sealed can containing said quantity of pressurized material;

a hollow housing having a rear region and a front region which leads said rear region, said can being rearwardly and slidably positioned within the hollow of said housing, said can being sized relative to said housing for being retained rearwardly in said housing prior to impact and for being adapted to slide forwardly toward said front region when said can impacts the target area;

exit means in said can for allowing said pressurized material to exit from said can; and actuating means on said housing for actuating said exit means to allow said pressurized material to exit from said can into said housing when said can slides toward said front region of said housing.

2. The projectile of claim 1, wherein said pressurized material comprises tear gas.

3. The projectile of claim 1, futher comprising a launching tube secured at said rear region of said housing and extending rearwardly therefrom.

4. The projectile of claim 3, further comprising a fin assembly mounted at said launching tube for orienting said housing relative to said target during flight of said projectile so that said housing impacts said target such that said can slides toward said front region of said housing.

5. The projectile of claim 1, wherein said housing further comprises a cap for enclosing said housing, said cap being held to said housing for popping off said housing upon pressure increase within said housing.

6. The projectile of claim 5, wherein said cap is friction fitted at said housing.

7. The projectile of claim 5, wherein said exit means includes means for rapidly releasing said pressurized material so that substantially all of said material is evacuated from said can to ensure that said can is tamper proof.

8. The projectile of claim 1, wherein said exit means is comprised of a frangible material and said actuating means comprises means for breaking said frangible material when said can slides forward in said housing.

9. The projectile of claim 8, wherein said means for breaking said frangible material comprises a pin in said housing for engaging and breaking said frangible material when said can slides forward in said housing.

10. The projectile of claim 9, wherein said housing further comprises a cap for enclosing said housing, said cap being held to said housing for popping off said housing upon pressure increase within said housing, said frangible material faces said cap, and said pin is mounted at said cap and extends inwardly in said housing toward said frangible material for contacting said frangible material when said can slides forward.

11. The projectile of claim 1, wherein said exit means comprises a valve which engages said actuating means and opens for permitting exit of material from said can when said can slides forward toward said front region.

12. The projectile of claim 11, wherein said valve includes means for holding said valve open once it opens.

13. The projectile of claim 12, wherein said valve comprises:

a hollow tube extending from a bottom thereof in said can and a top outside said can; an entrance into said tube being adjacent said bottom; and locking means on said tube, said exit means further comprising an exit opening from said can with an elastic sealing gasket therearound, said valve being positioned at said can opening so that initially said tube entrance is sealed by said elastic gasket and wherein said valve is actuated by pushing said tube into said can to expose said entrance; said locking means being adapted to engage said gasket when said valve is pushed into said can for preventing said tube from returning to its said initial position.

14. A projectile for delivering a quantity of pressurized material, said projectile comprising:

a hollow housing having an enclosed bottom and an opposite open top;

a launching tube secured at said bottom of said housing and extending rearwardly thereform; a fin assembly on said launching tube for orienting said projectile in such flight that said housing leads said launching tube when said projectile strikes said target;

a sealed can in said housing and containing said pressurized material, said can comprising a peripheral wall shaped for slidably and frictionally engaging said housing, said can being positioned rearwardly in said housing and spaced away from said open top of said housing;

exit means from said can for said pressurized material;

a cap for covering said open top of said housing and friction fitted to said housing; and actuating means in said housing for activating said exit means, said can being responsive to an impact between said cap and another object or surface to slide toward said cap for causing said actuating means to activate said exit means thereby to allow said pressurized material to escape said can and to create a pressure in said housing for blowing off said cap from said housing, whereby said material may be dispersed.

* * * * *